US011965142B2

(12) United States Patent
Fujita

(10) Patent No.: US 11,965,142 B2
(45) Date of Patent: Apr. 23, 2024

(54) LUBRICATING OIL COMPOSITION

(71) Applicant: Idemitsu Kosan Co., Ltd., Chiyoda-ku (JP)

(72) Inventor: Shoichiro Fujita, Chiba (JP)

(73) Assignee: Idemitsu Kosan Co., Ltd., Chiyoda-ku (JP)

( * ) Notice: Subject to any disclaimer, the term of this patent is extended or adjusted under 35 U.S.C. 154(b) by 0 days.

(21) Appl. No.: 17/442,216

(22) PCT Filed: Mar. 25, 2020

(86) PCT No.: PCT/JP2020/013226
§ 371 (c)(1),
(2) Date: Sep. 23, 2021

(87) PCT Pub. No.: WO2020/203524
PCT Pub. Date: Oct. 8, 2020

(65) Prior Publication Data

US 2022/0162516 A1 May 26, 2022

(30) Foreign Application Priority Data

Mar. 29, 2019 (JP) ..... 2019-065480

(51) Int. Cl.

| | |
|---|---|
| ***C10M 135/18*** | (2006.01) |
| ***C10M 129/54*** | (2006.01) |
| ***C10M 135/10*** | (2006.01) |
| ***C10M 141/08*** | (2006.01) |
| ***C10M 159/18*** | (2006.01) |
| ***C10M 163/00*** | (2006.01) |
| ***C10M 169/04*** | (2006.01) |
| *C10N 30/00* | (2006.01) |
| *C10N 30/02* | (2006.01) |
| *C10N 30/04* | (2006.01) |
| *C10N 40/25* | (2006.01) |

(52) U.S. Cl.
CPC ..... *C10M 169/045* (2013.01); *C10M 129/54* (2013.01); *C10M 135/10* (2013.01); *C10M 135/18* (2013.01); *C10M 141/08* (2013.01); *C10M 159/18* (2013.01); *C10M 163/00* (2013.01); *C10M 2203/003* (2013.01); *C10M 2207/144* (2013.01); *C10M 2207/262* (2013.01); *C10M 2219/044* (2013.01); *C10M 2219/046* (2013.01); *C10M 2219/068* (2013.01); *C10M 2229/00* (2013.01); *C10N 2030/02* (2013.01); *C10N 2030/04* (2013.01); *C10N 2030/52* (2020.05); *C10N 2040/25* (2013.01)

(58) Field of Classification Search
CPC ..... C10M 169/045; C10M 135/10; C10M 2207/262; C10M 2219/044; C10M 2219/046; C10N 2030/04; C10N 2030/52; C10N 2040/25
See application file for complete search history.

(56) References Cited

U.S. PATENT DOCUMENTS

| | | | | |
|---|---|---|---|---|
| 2008/0234153 | A1 | 9/2008 | Matsui | |
| 2009/0312208 | A1 | 12/2009 | Ishikawa et al. | |
| 2016/0348027 | A1 | 12/2016 | Utaka | |
| 2017/0158982 | A1 | 6/2017 | Tamura et al. | |
| 2017/0198234 | A1 | 7/2017 | Matsuki et al. | |
| 2018/0072962 | A1 | 3/2018 | Wada et al. | |
| 2018/0258365 | A1* | 9/2018 | Ohkubo | C10M 169/048 |
| 2018/0258366 | A1 | 9/2018 | Ohkubo et al. | |
| 2018/0334636 | A1* | 11/2018 | Hoshino | C10M 101/00 |
| 2018/0355272 | A1* | 12/2018 | Onodera | C10M 141/12 |
| 2019/0119601 | A1* | 4/2019 | Onouchi | C10M 141/12 |
| 2019/0264125 | A1 | 8/2019 | Iino et al. | |
| 2019/0270946 | A1* | 9/2019 | Hogendoorn | C10M 145/14 |
| 2019/0270947 | A1* | 9/2019 | Hogendoorn | C10M 167/00 |
| 2020/0308503 | A1* | 10/2020 | Sunahara | C10M 129/16 |
| 2020/0325411 | A1* | 10/2020 | Oki | C10M 169/04 |
| 2021/0269735 | A1* | 9/2021 | Knapton | C10M 161/00 |
| 2022/0098509 | A1* | 3/2022 | Tang | C10M 149/02 |
| 2022/0145206 | A1* | 5/2022 | McBride | C10M 163/00 |

FOREIGN PATENT DOCUMENTS

| | | | |
|---|---|---|---|
| CN | 106459819 | A | 2/2017 |
| CN | 106967479 | A | 7/2017 |
| CN | 107075405 | A | 8/2017 |

(Continued)

OTHER PUBLICATIONS

International Search Report dated Jun. 9, 2020 in PCT/JP2020/013226 filed on Mar. 25, 2020, 3 pages).
Combined Chinese Office Action and Search Report dated Jun. 13, 2022, in corresponding Chinese Patent Application No. 202080024175.X (with English Translation of Category of Cited Documents), 18 pages.
Hou Xianglin et al., "China Petroleum Refining Technology (2nd edition)", China Petrochemical Press, Jul. 31, 2001, pp. 516-517 with English Translation.

(Continued)

*Primary Examiner* — Ellen M McAvoy
(74) *Attorney, Agent, or Firm* — Oblon, McClelland, Maier & Neustadt, L.L.P.

(57) ABSTRACT

A lubricating oil composition containing a base oil, an organic molybdenum compound, and a metallic detergent, wherein the metallic detergent contains calcium sulfonate, and the content of the calcium sulfonate in terms of calcium atoms is 0.12% by mass or more based on the mass of the composition, the content ratio of molybdenum atoms derived from the organic molybdenum compound to soap groups derived from the metallic detergent based on the lubricating oil composition, [Mo/soap groups], is 0.02 or more at a mass ratio, and the HTHS viscosity at 150° C. is 1.3 mPa·s or more and less than 2.3 mPa·s. The lubricating oil composition has low viscosity and excellent lubricity.

20 Claims, No Drawings

(56) References Cited

FOREIGN PATENT DOCUMENTS

| | | | |
|---|---|---|---|
| CN | 107207991 | A | 9/2017 |
| CN | 107406790 | A | 11/2017 |
| CN | 107586586 | A | 1/2018 |
| CN | 108699473 | A | 10/2018 |
| EP | 2 011 854 | A1 | 1/2009 |
| JP | 2005-247995 | A | 9/2005 |
| JP | 2015-140354 | A | 8/2015 |
| JP | 2015-147890 | A | 8/2015 |
| JP | 2017-105886 | A | 6/2017 |
| JP | 2018-2794 | A | 1/2018 |
| WO | WO 2004/111162 | A1 | 12/2004 |
| WO | WO 2007/114260 | A1 | 10/2007 |
| WO | WO 2015/111746 | A1 | 7/2015 |
| WO | WO 2016/159006 | A1 | 10/2016 |
| WO | WO 2016/159185 | A1 | 10/2016 |
| WO | WO 2018/070362 | A1 | 4/2018 |

OTHER PUBLICATIONS

Extended European Search Report dated Oct. 28, 2022 to the corresponding European patent application No. 20784748.4, 6 pages.

* cited by examiner

LUBRICATING OIL COMPOSITION

TECHNICAL FIELD

The present invention relates to a lubricating oil composition.

BACKGROUND ART

In recent years, from the viewpoint of environmental protection, the fuel efficiency of automobiles and the like has become an important issue, and thus, lubricating oil for use in the internal combustion engine of an automobile and the like has also been required for the improvement of fuel efficiency. In general, lubricating oil for use in the internal combustion engine of an automobile and the like forms a lubricating oil film between sliding surfaces, so that it prevents a direct contact between the sliding surfaces and imparts lubricity to the internal combustion engine. As the viscosity of lubricating oil decreases, sliding resistance also decreases, which leads to fuel efficiency. Hence, the development of lubricating oil having low viscosity progresses, and utilization of low-viscosity lubricating oil having SAE viscosity grades of 0W-4 to 0W-12 has been studied.

However, as the viscosity of lubricating oil decreases, a lubricating oil film formed between the sliding surface tends to become thin. As such, even if lubricating oil having low viscosity is simply produced, there is a concern that contact frequency between the sliding surfaces will increase due to the breakdown of the oil film, and thus that poor lubricity (increased frictional wear) will be generated. Thus, both low viscosity and lubricity are properties, which are hardly achieved, simultaneously. In order to achieve both the low viscosity and the lubricity, studies have been conducted. For example, Patent Literatures 1 and 2 disclose a low-viscosity lubricating oil composition comprising a molybdenum succinimide compound or an organic molybdenum compound.

CITATION LIST

Patent Literature

Patent Literature 1: US Patent Application (Laid-Open) No. 2018/0258365

Patent Literature 2: US Patent Application (Laid-Open) No. 2018/0258366

SUMMARY OF INVENTION

Under such circumstances, it has been still desired to develop a lubricating oil composition having low viscosity and excellent lubricity.

The present inventors have conducted intensive studies directed towards achieving the aforementioned object. As a result, the present inventors have found that the oil film-forming ability of lubricating oil can be improved by mixing a specific calcium-based detergent and an organic molybdenum compound at a specific ratio, thereby completing the present invention.

The present invention includes the following embodiments.

[1] A lubricating oil composition comprising:
- a base oil,
- an organic molybdenum compound, and
- a metallic detergent, wherein
- the metallic detergent comprises calcium sulfonate, and the content of the calcium sulfonate in terms of calcium atoms is 0.12% by mass or more based on the mass of the composition,
- the content ratio of molybdenum atoms derived from the organic molybdenum compound to soap groups derived from the metallic detergent based on the lubricating oil composition, [Mo/soap groups], is 0.02 or more at a mass ratio, and
- the HTHS viscosity at 150° C. is 1.3 mPa·s or more and less than 2.3 mPa·s.

[1a] A lubricating oil composition comprising:
- a base oil,
- an organic molybdenum compound, and
- a metallic detergent, wherein
- the metallic detergent comprises calcium sulfonate, and the content of the calcium sulfonate in terms of calcium atoms is 1200 ppm by mass or more based on the mass of the composition,
- the content ratio of molybdenum atoms derived from the organic molybdenum compound to soap groups derived from the metallic detergent based on the lubricating oil composition, [Mo/soap groups], is 0.02 or more at a mass ratio, and
- the HTHS viscosity at 150° C. is 1.3 mPa·s or more and less than 2.3 mPa·s.

[2] A lubricating oil composition comprising:
- a base oil,
- an organic molybdenum compound, and
- a metallic detergent, wherein
- the metallic detergent comprises overbased calcium salicylate,
- the content ratio of molybdenum atoms derived from the organic molybdenum compound to soap groups derived from the metallic detergent based on the lubricating oil composition, [Mo/soap groups], is 0.02 or more at a mass ratio, and
- the HTHS viscosity at 150° C. is 1.3 mPa·s or more and less than 2.3 mPa·s.

[3] The composition according to the above [1], [1a], or [2], wherein the content of the organic molybdenum compound in terms of molybdenum atoms is 0.02% by mass or more and less than 0.10% by mass based on the mass of the composition.

[3a] The composition according to the above [1], [1a], or [2], wherein the content of the organic molybdenum compound in terms of molybdenum atoms is 200 ppm by mass or more and less than 1000 ppm by mass based on the mass of the composition.

[4] The composition according to any one of the above [1] to [3], [1a], and [3a], wherein the content of a magnesium-based detergent in terms of magnesium atoms is less than 0.05% by mass based on the mass of the composition.

[4a] The composition according to any one of the above [1] to [3], [1a], and [3a], wherein the content of a magnesium-based detergent in terms of magnesium atoms is less than 500 ppm by mass based on the mass of the composition.

[5] The composition according to any one of the above [1] to [4], [1a], [3a], and [4a], wherein the organic molybdenum compound comprises at least one selected from the group consisting of molybdenum dithiocarbamate, molybdenum dithiophosphate, a molybdenum-amine complex, and a molybdenum-imide complex.

[6] The composition according to any one of the above [1] to [5], [1a], [3a], and [4a], wherein the content of the viscosity index improver is 2% by mass or less based on the mass of the composition.

[7] The composition according to any one of the above [1] to [6], [1a], [3a], and [4a], wherein the content of neutral calcium salicylate in terms of calcium atoms is less than 0.01% by mass based on the mass of the composition.

[7a] The composition according to any one of the above [1] to [6], [1a], [3a], and [4a], wherein the content of neutral calcium salicylate in terms of calcium atoms is less than 100 ppm by mass based on the mass of the composition.

[8] The composition according to any one of the above [1] to [7], [1a], [3a], [4a], and [7a], wherein the kinematic viscosity of the lubricating oil composition at 100° C. is 2.0 to 7.1 $mm^2/s$.

[9] The composition according to any one of the above [1] to [8], [3a], [4a], and [7a], which satisfies any one of the following:

(i) the calcium-based detergent only comprises overbased calcium salicylate, (ii) the calcium-based detergent only comprises overbased calcium sulfonate, (iii) the calcium-based detergent only comprises overbased calcium salicylate and neutral calcium salicylate, or (iv) the calcium-based detergent only comprises overbased calcium sulfonate and neutral calcium sulfonate.

[10] The composition according to any one of the above [1] to [9], [3a], [4a], and [7a], wherein the base number of the lubricating oil composition is 6.0 mgKOH/g or more and 11.0 mgKOH/g or less.

[11] An internal combustion engine, in which the composition according to any one of the above [1] to [10], [3a], [4a], and [7a] is used.

[12] A method of reducing abrasion of an internal combustion engine, comprising driving the internal combustion engine using the composition according to any one of the above [1] to [10], [3a], [4a], and [7a].

According to the present invention, a lubricating oil composition having low viscosity and excellent lubricity (in particular, low frictional wear) is provided.

DESCRIPTION OF EMBODIMENTS

Hereinafter, the embodiments of the present invention will be described in detail. Besides, the present invention is not limited to the following embodiments, and the present invention may be arbitrarily modified and carried out unless it deviates from the spirit thereof.

The upper limit value and lower limit value of the numerical range described in the present description can be arbitrarily combined with each other. For example, if "A to B" and "C to D" are described, the ranges "A to D" and "C to B" are also encompassed as numerical ranges in the scope of the present invention. In addition, the numerical range "the lower limit value to the upper limit value" described in the present description means that the value is the lower limit value or more and the upper limit value or less.

Hereafter, the meanings of the terms, etc. used in the present description will be described.

The "hydrocarbon group" means a linear, cyclic or branched, saturated or unsaturated hydrocarbon having a specified number of carbon atoms, from which 1 or 2 or more hydrogen atoms are removed. Specific examples of the hydrocarbon group may include an alkyl group, an alkenyl group, a cycloalkyl group, a cycloalkenyl group, an aryl group, an alkylaryl group, an arylalkyl group, an alkylene group, and an alkenylene group.

The "alkyl group" means a linear or branched, monovalent saturated aliphatic hydrocarbon group having a specified number of carbon atoms.

The "cycloalkyl group" means a cyclic monovalent saturated aliphatic hydrocarbon group having a specified number of carbon atoms.

The "alkylene group" means a linear, cyclic or branched, divalent saturated aliphatic hydrocarbon group having a specified number of carbon atoms.

The "alkenyl group" means a linear or branched, monovalent hydrocarbon group having a specified number of carbon atoms and having at least one carbon-carbon double bond.

The "cycloalkenyl group" means a cyclic monovalent hydrocarbon group having a specified number of carbon atoms and having at least one carbon-carbon double bond.

The "alkenylene group" means a linear or branched, divalent hydrocarbon group having a specified number of carbon atoms and having at least one carbon-carbon double bond.

Examples of the "alkenyl" or "alkenylene" may include, but are not limited to, monoene, diene, triene, and tetraene.

The "aryl group" means an aromatic hydrocarbon cyclic group.

The "alkylaryl group" means aryl to which one or more alkyl groups bind.

The "arylalkyl group" means alkyl that binds to an aryl ring.

One embodiment of the present invention relates to a lubricating oil composition. This lubricating oil composition comprises the following components: (A) a base oil, (B) an organic molybdenum compound, and (C) a metallic detergent, and as necessary, (D) other components.

In the lubricating oil composition of one embodiment of the present invention, the metallic detergent comprises calcium sulfonate, and the content of the calcium sulfonate in terms of calcium atoms is 0.12% by mass or more based on the mass of the composition, the content ratio of molybdenum atoms derived from the organic molybdenum compound to soap groups derived from the metallic detergent based on the lubricating oil composition, [Mo/soap groups], is 0.02 or more at a mass ratio, and the HTHS viscosity at 150° C. is 1.3 mPa·s or more and less than 2.3 mPa·s.

In the lubricating oil composition of another embodiment of the present invention, the metallic detergent comprises overbased calcium salicylate, the content ratio of molybdenum atoms derived from the organic molybdenum compound to soap groups derived from the metallic detergent based on the lubricating oil composition, [Mo/soap groups], is 0.02 or more at a mass ratio, and the HTHS viscosity at 150° C. is 1.3 mPa·s or more and less than 2.3 mPa·s.

Conventionally, a lubricating oil composition comprising an organic molybdenum compound and a calcium-based detergent had been known (for example, Patent Literatures 1 and 2). However, the relationship between the type of the calcium-based detergent or the mixing ratio of the calcium-based detergent and the organic molybdenum compound, and lubricating oil film-forming ability, had not been studied. The present inventors have found that the type of the calcium-based detergent and the mixing ratio of the calcium-based detergent and the organic molybdenum compound have an influence on the lubricating oil film-forming ability. Then, the present inventors have found that the lubricating oil composition of the above-described embodiment is able to achieve both low viscosity and excellent lubricity (low frictional wear).

The lubricating oil composition may comprise another compound that is generated as a result of degeneration, reaction, etc. of at least a part of the mixed components in some cases. Such an embodiment is also included in the lubricating oil composition of the present invention.

Hereinafter, individual components will be described in detail.

[Component (A): Base Oil]

As a base oil, any given oil can be appropriately selected and used from mineral oils and synthetic oils conventionally used as base oils for lubricating oil. Such a base oil is preferably selected such that, for example, the lubricating oil composition can obtain desired properties (for example, desired HTHS viscosity, as described later).

Examples of the mineral oil may include: atmospheric residual oil obtained by subjecting crude oil such as paraffin-based crude oil, intermediate-based crude oil, or naphthenic crude oil to atmospheric distillation; distilled oil obtained by subjecting such atmospheric residual oil to vacuum distillation; and refined oil obtained by subjecting the distilled oil to one or more purification treatments such as solvent removal, solvent extraction, hydrocracking, solvent dewaxing, contact dewaxing, and hydrorefining. These mineral oils may be used alone or may also be used in combination of two or more types.

Examples of the synthetic oil may include: poly α-olefin such as an α-olefin homopolymer or an α-olefin copolymer (e.g., an α-olefin copolymer containing 8 to 14 carbon atoms, such as an ethylene-α-olefin copolymer); isoparaffin; polyalkylene glycol; ester oil such as polyol ester, dibasic acid ester, or phosphoric acid ester; ether oil such as polyphenyl ether; alkyl benzene; alkyl naphthalene; and oil (GTL) obtained by isomerization of wax (GTL wax (Gas To Liquids WAX)) produced from natural gas according to a Fischer-Tropsch process. These synthetic oils may be used alone or may also be used in combination of two or more types.

One or more types of the above-described mineral oils may be combined with one or more types of the above-described synthetic oils, and the thus mixed oil may be used as a base oil.

Among others, the base oils used herein are preferably one or more selected from mineral oils and synthetic oils that are classified into Group 2 and Group 3 of the API (American Petroleum Institute) base oil category.

The base oil is a main ingredient of the lubricating oil composition, and in general, the content of the base oil is preferably 60% to 99.5% by mass, more preferably 70% to 99.0% by mass, further preferably 80% to 98.0% by mass, and particularly preferably 85% to 97.0% by mass, based on the total amount of the composition.

The kinematic viscosity of the base oil at 100° C. is not particularly limited, and from the viewpoint of fuel efficiency, it is preferably 2 to 10 $mm^2/s$, more preferably 2 to 6 $mm^2/s$, and further preferably 3 to 5 $mm^2/s$.

From the viewpoint of suppression of a change in viscosity due to temperature change and the improvement of fuel efficiency, the viscosity index of base oil (A) is preferably 80 or more, more preferably 90 or more, and further preferably 100 or more. By setting the viscosity index of the base oil within the aforementioned range, the viscosity properties of the lubricating oil composition can be easily improved.

Besides, in the present description, the value of the kinematic viscosity of the base oil and the lubricating oil composition at 40° C., and the kinematic viscosity at 100° C. and the viscosity index thereof are measured in accordance with JIS K2283:2000.

[Component (B): Organic Molybdenum Compound]

An organic molybdenum compound is added for the purpose of imparting friction resistance to the lubricating oil composition.

The organic molybdenum compound is not particularly limited, as long as it may function as a friction modifier in the lubricating oil composition. For example, the organic molybdenum compound may be at least one selected from molybdenum dithiocarbamate (MoDTC), molybdenum dithiophosphate (MoDTP), a molybdenum-amine complex (Mo-amine complex), and a molybdenum-imide complex (Mo-imide complex). Among others, preferably, in terms of easy improvement of the lubricating oil film-forming ability of the lubricating oil composition, MoDTC and a Mo-amine complex are preferable, and MoDTC is more preferable.

In terms of easy improvement of the lubricating oil film-forming ability of the lubricating oil composition, the mass ratio of molybdenum atoms contained in the organic molybdenum compound (molybdenum content percentage) is preferably in the range of 1% to 30% by mass, more preferably in the range of 4% to 15% by mass, and further preferably in the range of 5% to 12% by mass.

(MoDTC)

Examples of the molybdenum dithiocarbamate (MoDTC) may include binuclear molybdenum dithiocarbamate containing two molybdenum atoms in a single molecule thereof, and trinuclear molybdenum dithiocarbamate containing three molybdenum atoms in a single molecule thereof. It is to be noted that molybdenum dithiocarbamate may be used alone or may also be used in combination of two or more types.

The binuclear molybdenum dithiocarbamate may be, for example, a molybdenum dithiocarbamate compound containing two molybdenum atoms in a single molecule thereof, which is described in JP Patent Publication (Kokai) No. 2017-149830 A. Preferred examples of the binuclear molybdenum dithiocarbamate may include a compound represented by the following general formula (i) and a compound represented by the following general formula (ii):

[Formula 1]

(i)

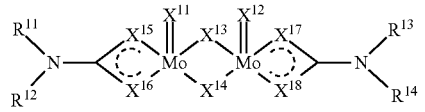

(ii)

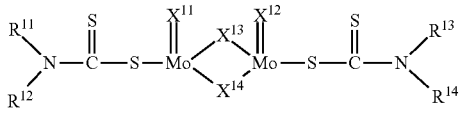

In the above general formulae (i) and (ii), $X^{11}$ to $X^{18}$ each independently represent an oxygen atom or a sulfur atom. $X^{11}$ to $X^{18}$ may be identical to or different from one another. However, at least two of $X^{11}$ to $X^{18}$ in the formula (i) are sulfur atoms. In one embodiment of the present invention, it is preferable that $X^{11}$ and $X^{12}$ in the formula (i) are oxygen atoms, and that $X^{13}$ to $X^{18}$ in the formula (i) are sulfur atoms.

$X^{11}$ to $X^{14}$ in the formula (ii) are preferably oxygen atoms.

In the above general formula (i), from the viewpoint of the improvement of solubility in the base oil, the molar ratio between sulfur atoms and oxygen atoms, [sulfur atoms/oxygen atoms], in $X^{11}$ to $X^{18}$ is preferably 1/4 to 4/1, and more preferably 1/3 to 3/1.

In the above general formula (ii), from the same viewpoint as described above, the molar ratio between sulfur atoms and oxygen atoms, [sulfur atoms/oxygen atoms], in $X^{11}$ to $X^{14}$ is preferably 1/3 to 3/1, and more preferably 1.5/2.5 to 2.5/1.5.

In the above general formulae (i) and (ii), $R^{11}$ to $R^{14}$ each independently represent a hydrocarbon group, and these hydrocarbon groups may be identical to or different from one another.

The number of carbon atoms contained in the hydrocarbon group represented by each of $R^{11}$ to $R^{14}$ is preferably 7 to 22, more preferably 7 to 18, further preferably 7 to 14, and still further preferably 8 to 13.

Specific examples of the hydrocarbon groups that can be selected as $R^{11}$ to $R^{14}$ in the above formulae (i) and (ii) may include: alkyl groups, such as a methyl group, an ethyl group, a propyl group, a butyl group, a pentyl group, a hexyl group, a heptyl group, an octyl group, a nonyl group, a decyl group, an undecyl group, a dodecyl group, a tridecyl group, a tetradecyl group, a pentadecyl group, hexadecyl group, a heptadecyl group, and an octadecyl group; alkenyl groups, such as an octenyl group, a nonenyl group, a decenyl group, an undecenyl group, a dodecenyl group, a tridecenyl group, a tetradecenyl group, and a pentadecenyl group; cycloalkyl groups such as a cyclohexyl group; alkyl-substituted cycloalkyl groups, such as a dimethylcyclohexyl group, an ethylcyclohexyl group, a methylcyclohexylmethyl group, a cyclohexylethyl group, a propylcyclohexyl group, a butylcyclohexyl group, and a heptylcyclohexyl group; aryl groups, such as a phenyl group, a naphthyl group, an anthracenyl group, a biphenyl group, and a terphenyl group; alkylaryl groups, such as a tolyl group, a dimethylphenyl group, a butylphenyl group, a nonylphenyl group, a methylbenzyl group, and a dimethylnaphthyl group; and arylalkyl groups, such as a phenylmethyl group, a phenylethyl group, and a diphenylmethyl group.

The trinuclear molybdenum dithiocarbamate may be, for example, a molybdenum dithiocarbamate compound containing three molybdenum atoms in a single molecule thereof, which is described in paragraphs [0052] to [0066] of JP Patent Publication (Kokai) No. 2017-149830 A.

(MoDTP)

Examples of the molybdenum dithiophosphate (MoDTP) may include a compound represented by the following formula (iv) and a compound represented by the following formula (v):

[Formula 2]

(iv)

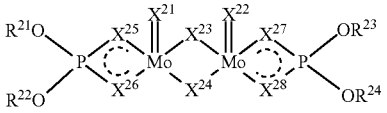

(v)

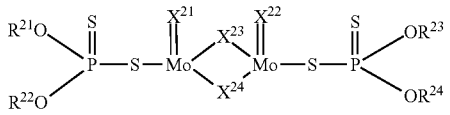

In the above formulae (iv) and (v), $R^{21}$ to $R^{24}$ each independently represent a hydrocarbon group, and these hydrocarbon groups may be identical to or different from one another. The number of carbon atoms contained in the hydrocarbon group that can be selected as $R^{21}$ to $R^{24}$ is preferably 1 to 20, more preferably 5 to 18, further preferably 5 to 16, and still further preferably 5 to 12. Besides, the hydrocarbon groups that can be selected as $R^{21}$ to $R^{24}$ in the formulae (iv) and (v) may be the same as the hydrocarbon groups that can be selected as $R^{11}$ to $R^{14}$ in the aforementioned general formula (i) or (ii).

In the above formulae (iv) and (v), $X^{21}$ to $X^{28}$ each independently represent an oxygen atom or a sulfur atom, and they may be identical to or different from one another. However, at least two of $X^{21}$ to $X^{28}$ in the formula (iv) are sulfur atoms.

In the above formula (iv), from the viewpoint of the improvement of solubility in the base oil, the molar ratio between sulfur atoms and oxygen atoms, [sulfur atoms/oxygen atoms], in $X^{21}$ to $X^{21}$ is preferably 1/4 to 4/1, and more preferably 1/3 to 3/1.

On the other hand, in the above formula (v), from the same viewpoint as described above, the molar ratio between sulfur atoms and oxygen atoms, [sulfur atoms/oxygen atoms], in $X^{21}$ to $X^{24}$ is preferably 1/3 to 3/1, and more preferably 1.5/2.5 to 2.5/1.5.

(Mo-Amine Complex)

The molybdenum-amine complex (Mo-amine complex) may be, for example, a molybdenum-amine complex formed by reacting a hexavalent molybdenum compound (for example, molybdenum trioxide and/or molybdic acid) with an amine compound. For example, a compound obtained by the production method described in JP Patent Publication (Kokai) No. 2003-252887 A can be used.

The amine compound that reacts with the hexavalent molybdenum compound is not particularly limited. Specific examples of the amine compound may include monoamine, diamine, polyamine, and alkanolamine. More specific examples may include: alkylamines having an alkyl group containing 1 to 30 carbon atoms (wherein the alkyl group may be either a linear or branched alkyl group), such as methylamine, ethylamine, dimethylamine, diethylamine, methylethylamine, and methylpropylamine; alkenylamines having an alkenyl group containing 2 to 30 carbon atoms (wherein the alkenyl group may be either a linear or branched alkenyl group), such as ethenylamine, propenylamine, butenylamine, octenylamine, and oleylamine; alkanolamines having an alkanol group containing 1 to 30 carbon atoms (wherein the alkanol group may be either a linear or branched alkanol group), such as methanolamine, ethanolamine, methanolethanolamine, and methanolpropanolamine; alkylenediamines having an alkylene group containing 1 to 30 carbon atoms, such as methylenediamine, ethylenediamine, propylenediamine, and butylenediamine; polyamines, such as diethylenetriamine, triethylenetetramine, tetraethylenepentamine, and pentaethylenehexamine; compounds, in which the above-described monoamine, diamine or polyamine has an alkyl group or an alkenyl group containing 8 to 20 carbon atoms, such as undecyldiethylamine, undecyldiethanolamine, dodecyldipropanolamine, oleyldiethanolamine, oleylpropylenediamine, and stearyltetraethylenepentamine, or heterocyclic compounds such as imidazoline; alkylene oxide adducts of these compounds; and the mixtures thereof.

(Mo-Imide Complex)

Examples of the molybdenum-imide complex (Mo-imide complex) may include: a complex of a sulfur-containing molybdenum compound such as molybdenum sulfide or molybdic acid sulfide, and alkyl succinimide or alkenyl succinimide; and a complex of a hexavalent molybdenum compound (for example, molybdenum trioxide and/or molybdic acid) and alkyl succinimide or alkenyl succinimide. Specific examples thereof may include: a sulfur-containing molybdenum complex of succinimide, as described in JP Patent Publication (Kokoku) No. 3-22438 B (1991) and JP Patent Publication (Kokai) No. 2004-2866 A; and a molybdenum succinimide complex as described in U.S. Patent Application Laid-Open No. 2018/0258365.

The content of the organic molybdenum compound can be converted to the content of molybdenum atoms (Mo) derived from the organic molybdenum compound. Preferably, from the viewpoint of easy improvement of the lubricating oil film-forming ability of the lubricating oil composition, the content of the organic molybdenum compound in terms of the organic molybdenum compound-derived molybdenum atoms in the lubricating oil composition (hereinafter simply referred to as "molybdenum content" at times) is preferably 0.02% by mass or more, more preferably 0.025% by mass or more, and further preferably 0.03% by mass or more, based on the total amount of the composition. On the other hand, from the viewpoint of the solubility of additives, the molybdenum content is preferably 0.10% by mass or less, more preferably 0.09% by mass or less, and further preferably 0.08% by mass or less, based on the total amount of the composition. For example, the molybdenum content is preferably 0.02% by mass or more and 0.10% by mass or less, more preferably 0.025% by mass or more and 0.09% by mass or less, and further preferably 0.03% by mass or more and 0.08% by mass or less, based on the total amount of the composition.

Otherwise, the molybdenum content can also be indicated with "ppm by mass," and in such a case, the molybdenum content is preferably 200 ppm by mass or more, more preferably 250 ppm by mass or more, and further preferably 300 ppm by mass or more. On the other hand, the molybdenum content is preferably 1000 ppm by mass or less, more preferably 900 ppm by mass or less, and further preferably 800 ppm by mass or less. Further, the molybdenum content is preferably 200 ppm by mass or more and 1000 ppm by mass or less, more preferably 250 ppm by mass or more and 900 ppm by mass or less, and further preferably 300 ppm by mass or more and 800 ppm by mass or less, based on the total amount of the composition.

With regard to the content of the organic molybdenum compound, the above-described molybdenum content in terms of molybdenum atoms is preferably within the above-described range. For example, from the viewpoint of easy improvement of the lubricating oil film-forming ability of the lubricating oil composition, the content of the organic molybdenum compound is preferably 0.05% to 5% by mass, more preferably 0.1% to 3% by mass, and further preferably 0.2% to 2% by mass, based on the total amount of the composition.

[Component (C): Metallic Detergent]

(Calcium-Based Detergent)

The lubricating oil composition comprises, as a metallic detergent, a calcium-based detergent having the following embodiment (i) and/or (ii):

(i) The calcium-based detergent comprises calcium sulfonate, and the content of the calcium sulfonate in terms of calcium atoms is 0.2% by mass or more (or 1200 ppm by mass or more) based on the mass of the composition.

(ii) The calcium-based detergent comprises overbased calcium salicylate.

By allowing the lubricating oil composition to comprise a calcium-based detergent satisfying the above-described (i) and/or (ii), as well as an organic molybdenum compound, the lubricating oil film-forming ability of the composition on sliding surfaces is improved, and thereby, poor lubricity (increased frictional wear) due to the breakdown of the oil film can be prevented.

Embodiment (i)

In the above (i), the calcium sulfonate is not particularly limited, and a neutral salt, a basic salt, an overbased salt, or a mixture thereof can be used. Examples of the calcium sulfonate may include: a calcium salt (neutral calcium sulfonate) obtained by directly reacting alkyl aromatic sulfonic acid such as alkyl benzenesulfonic acid obtained by sulfonation of an alkyl aromatic compound with a base such as a calcium oxide or hydroxide, or by converting once the alkyl aromatic sulfonic acid to an alkali metal salt such as a sodium salt or a potassium salt, and then substituting it with calcium; a basic calcium salt (based calcium sulfonate) obtained by reacting the above-described neutral calcium salt with calcium oxide and/or calcium hydroxide; and an overbased calcium salt (overbased calcium sulfonate) obtained by reacting the above-described neutral calcium salt or the above-described basic calcium salt with excessive calcium oxide and/or calcium hydroxide in the presence of carbon dioxide, or boric acid or borate. The sulfonating agent is not particularly limited, and in general, oleum or sulfuric acid is used.

Among others, from the viewpoint of easy improvement of the lubricating oil film-forming ability of the lubricating oil composition, overbased calcium sulfonate and neutral calcium sulfonate are preferable, and a single use of overbased calcium sulfonate or a combined use of overbased calcium sulfonate and neutral calcium sulfonate is more preferable.

In the case of using overbased calcium sulfonate, its base number is preferably 150 mgKOH/g or more, more preferably 150 to 500 mgKOH/g, and further preferably 150 to 450 mgKOH/g.

In the case of using neutral calcium sulfonate, its base number is preferably 80 mgKOH/g or less, more preferably 5 to 50 mgKOH/g, and further preferably 10 to 30 mgKOH/g.

From the viewpoint of the improvement of the lubricating oil film-forming ability of the lubricating oil composition, the content of calcium sulfonate in terms of calcium atoms is preferably 0.12% by mass or more, and more preferably 0.13% by mass or more, based on the total amount of the composition. In addition, the upper limit value is not particularly limited, and from the viewpoint of reducing the ash content in the lubricating oil composition, the upper limit value is preferably 0.20% by mass or less, more preferably 0.19% by mass or less, and further preferably 0.18% by mass or less. For example, the content of calcium sulfonate in terms of calcium atoms is preferably 0.12% by mass or more and 0.20% by mass or less, more preferably 0.12% by mass or more and 0.19% by mass or less, and further preferably 0.13% by mass or more and 0.18% by mass or less, based on the total amount of the composition.

Otherwise, the content of calcium sulfonate in terms of calcium atoms can also be indicated with "ppm by mass," and in such a case, the content is preferably 1200 ppm by mass or more, and more preferably 1300 ppm by mass or more, based on the total amount of the composition. In addition, the upper limit value is preferably 2000 ppm by mass or less, more preferably 1900 ppm by mass or less, and further preferably 1800 ppm by mass or less. Moreover, the content of calcium sulfonate in terms of calcium atoms is preferably 1200 ppm by mass or more and 2000 ppm by mass or less, more preferably 1200 ppm by mass or more and 1900 ppm by mass or less, and further preferably 1300 ppm by mass or more and 1800 ppm by mass or less, based on the total amount of the composition.

From the viewpoint of the improvement of the lubricating oil film-forming ability of the lubricating oil composition, the content of overbased calcium sulfonate in terms of calcium atoms is preferably 0.12% by mass or more, and more preferably 0.13% by mass or more, based on the total amount of the composition. On the other hand, from the viewpoint of reducing the ash content in the lubricating oil composition, the content of overbased calcium sulfonate in terms of calcium atoms is preferably 0.20% by mass or less, more preferably 0.19% by mass or less, and further preferably 0.18% by mass or less. For example, the content of overbased calcium sulfonate in terms of calcium atoms is preferably 0.12% by mass or more and 0.20% by mass or less, more preferably 0.12% by mass or more and 0.19% by mass or less, and further preferably 0.13% by mass or more and 0.18% by mass or less, based on the total amount of the composition.

Otherwise, the content of overbased calcium sulfonate in terms of calcium atoms can also be indicated with "ppm by mass," and in such a case, the content is preferably 1200 ppm by mass or more, and more preferably 1300 ppm by mass or more, based on the total amount of the composition. On the other hand, the content of overbased calcium sulfonate in terms of calcium atoms is preferably 2000 ppm by mass or less, more preferably 1900 ppm by mass or less, and further preferably 1800 ppm by mass or less. In addition, the content of overbased calcium sulfonate in terms of calcium atoms is preferably 1200 ppm by mass or more and 2000 ppm by mass or less, more preferably 1200 ppm by mass or more and 1900 ppm by mass or less, and further preferably 1300 ppm by mass or more and 1800 ppm by mass or less, based on the total amount of the composition.

From the viewpoint of the improvement of the lubricating oil film-forming ability of the lubricating oil composition, the content of neutral calcium sulfonate in terms of calcium atoms is 0% by mass or more, preferably 0.01% by mass or more, and more preferably 0.02% by mass or more, based on the total amount of the composition. On the other hand, from the viewpoint of easy improvement of the lubricating oil film-forming ability of the lubricating oil composition, the content of neutral calcium sulfonate in terms of calcium atoms is preferably 0.20% by mass or less, more preferably 0.14% by mass or less, and further preferably 0.08% by mass or less. For example, the content of neutral calcium sulfonate in terms of calcium atoms is preferably 0% by mass or more and 0.20% by mass or less, more preferably 0.01% by mass or more and 0.14% by mass or less, and further preferably 0.02% by mass or more and 0.08% by mass or less, based on the total amount of the composition.

Otherwise, the content of neutral calcium sulfonate in terms of calcium atoms can also be indicated with "ppm by mass," and in such a case, the content is 0 ppm by mass or more, preferably 100 ppm by mass or more, more preferably 200 ppm by mass or more, based on the total amount of the composition. On the other hand, the content of neutral calcium sulfonate in terms of calcium atoms is preferably 2000 ppm by mass or less, more preferably 1400 ppm by mass or less, and further preferably 800 ppm by mass or less. In addition, the content of neutral calcium sulfonate in terms of calcium atoms is preferably 0 ppm by mass or more and 2000 ppm by mass or less, more preferably 100 ppm by mass or more and 1400 ppm by mass or less, and further preferably 200 ppm by mass or more and 800 ppm by mass or less, based on the total amount of the composition.

When the lubricating oil composition comprises both the overbased calcium sulfonate and the neutral calcium sulfonate, from the viewpoint of easy improvement of the lubricating oil film-forming ability of the lubricating oil composition, the mass ratio between the content of the overbased calcium sulfonate and the content of the neutral calcium sulfonate, which are each in terms of calcium atoms, is preferably in the range of 10:90 to 60:40, more preferably in the range of 20:80 to 70:20, and further preferably in the range of 55:45 to 80:20.

Embodiment (ii)

In the above (ii), the overbased calcium salicylate may be, for example, an overbased calcium salt (overbased calcium salicylate), which is obtained by reacting a calcium salt (neutral calcium salicylate) obtained by directly reacting alkyl salicylate such as dialkyl salicylate with a base such as a calcium oxide or hydroxide, or by converting once the alkyl salicylate to an alkali metal salt such as a sodium salt or a potassium salt and then substituting it with calcium, or a basic calcium salt (basic calcium salicylate) obtained by reacting the above-described neutral calcium salt with calcium oxide and/or calcium hydroxide, with excessive calcium oxide and/or calcium hydroxide in the presence of carbon dioxide, or boric acid or borate.

The base number of the overbased calcium salicylate is preferably 150 mgKOH/g or more, more preferably 150 to 400 mgKOH/g, and further preferably 200 to 300 mgKOH/g.

From the viewpoint of the improvement of the lubricating oil film-forming ability of the lubricating oil composition, the content of the overbased calcium salicylate in terms of calcium atoms is preferably 0.11% by mass or more, more preferably 0.12% by mass or more, and further preferably 0.13% by mass or more, based on the total amount of the composition. On the other hand, from the viewpoint of reducing the ash content, the content of the overbased calcium salicylate in terms of calcium atoms is preferably 0.20% by mass or less, more preferably 0.19% by mass or less, and further preferably 0.18% by mass or less. For example, the content of the overbased calcium salicylate in terms of calcium atoms is preferably 0.11% by mass or more and 0.20% by mass or less, more preferably 0.12% by mass or more and 0.19% by mass or less, and further preferably 0.13% by mass or more and 0.18% by mass or less, based on the total amount of the composition.

Otherwise, the content of the overbased calcium salicylate in terms of calcium atoms can also be indicated with "ppm by mass," and in such a case, the content is preferably 1100 ppm by mass or more, more preferably 1200 ppm by mass or more, and further preferably 1300 ppm by mass or more, based on the total amount of the composition. On the other hand, the content of the overbased calcium salicylate in terms of calcium atoms is preferably 2000 ppm by mass or less, more preferably 1900 ppm by mass or less, and further preferably 1800 ppm by mass or less. In addition, the content of the overbased calcium salicylate in terms of calcium atoms is preferably 1100 ppm by mass or more and 2000 ppm by mass or less, more preferably 1200 ppm by mass or more and 1900 ppm by mass or less, and further preferably 1300 ppm by mass or more and 1800 ppm by mass or less, based on the total amount of the composition.

In the above embodiment (i), the calcium-based detergent may comprise a calcium-based detergent other than calcium sulfonate (e.g., neutral, basic, and/or overbased calcium salicylate and/or calcium phenate).

On the other hand, in the above embodiment (ii), the calcium-based detergent may comprise a calcium-based detergent other than overbased calcium salicylate (e.g., neutral, basic, and/or overbased calcium phenate and/or calcium sulfonate, or neutral or basic calcium salicylate).

Examples of the calcium phenate may include: a neutral calcium salt (neutral calcium phenate) obtained by directly reacting alkyl phenol, alkyl phenol sulfide, a Mannich reaction product of alkyl phenol, or the like with a base such as a calcium oxide or hydroxide, or by converting once the alkyl phenol, the alkyl phenol sulfide, the Mannich reaction product of the alkyl phenol, or the like to an alkali metal salt such as a sodium salt or a potassium salt, and then substituting it with calcium; a basic calcium salt (basic calcium phenate) obtained by reacting the above-described neutral calcium salt with calcium oxide and/or calcium hydroxide; and overbased calcium salt (overbased calcium phenate) obtained by reacting the above-described neutral calcium salt or the above-described basic calcium salt with excessive calcium oxide and/or calcium hydroxide in the presence of carbon dioxide or boric acid or borate.

Hereafter, examples of the structure of the calcium-based detergent will be given. The following formula (I-1) shows an example of the neutral calcium sulfonate, the following formula (I-2) shows overbased calcium sulfonate. Moreover, the following formula (II-1) shows an example of the neutral calcium salicylate, and the following formula (II-2) shows overbased calcium salicylate. Furthermore, the following formula (III-1) shows an example of the neutral calcium phenate, and the following formula (III-2) shows overbased calcium phenate.

[Formula 3]

(I-1)

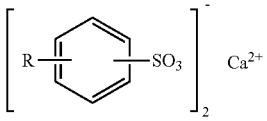

(I-2)

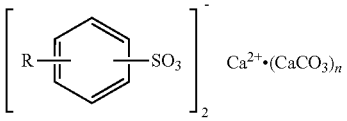

(II-1)

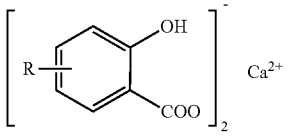

(II-2)

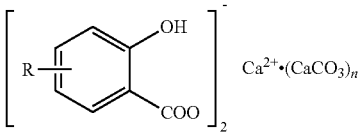

-continued (III-1)

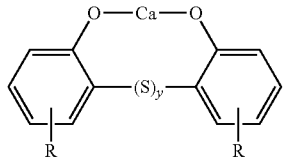

(III-2)

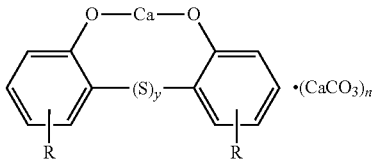

In the above formulae (I-1), (I-2), (II-1), (II-2), (III-1), and (III-2), R represents a hydrocarbon group containing 3 to 36 carbon atoms. Examples of such a hydrocarbon group may include an alkyl group containing 10 to 36 carbon atoms, an alkenyl group containing 10 to 36 carbon atoms, a cycloalkyl group containing 3 to 18 ring-forming carbon atoms, an aryl group containing 6 to 18 ring-forming carbon atoms, an alkylaryl group containing 10 to 36 carbon atoms, and an arylalkyl group containing 7 to 18 carbon atoms.

In the above formulae (I-2), (II-2), and (III-2), n represents a number of greater than 0.

In the above formulae, y represents an integer of 0 or more, and preferably an integer of 0 to 3.

Besides, with regard to the overbased calcium salt (e.g., overbased calcium salicylate, overbased calcium sulfonate, or overbased calcium phenate), detergent molecules (soap groups) of neutral calcium salicylate, neutral calcium sulfonate, neutral calcium phenate or the like generally surround the fine particles of calcium carbonate that is an overbased component in the lubricating oil composition, so as to form micelles.

The base number of the calcium-based detergent is generally 5 to 450 mgKOH/g, preferably 10 to 400 mgKOH/g, and more preferably 15 to 350 mgKOH/g. It is to be noted that the "base number" is measured by applying a potentiometric titration method (base number-perchloric acid method) in accordance with JIS K2501:2003.

As a calcium-based detergent, the above-described calcium-based detergent may be used alone, or the above-described calcium-based detergents having different properties or structures may be used in combination with two or more types.

In one embodiment of the present invention, the calcium-based detergent is any one of the following (i) to (iv):

(i) the calcium-based detergent only comprises overbased calcium salicylate, (ii) the calcium-based detergent only comprises overbased calcium sulfonate, (iii) the calcium-based detergent only comprises overbased calcium salicylate and neutral calcium salicylate, or (iv) the calcium-based detergent only comprises overbased calcium sulfonate and neutral calcium sulfonate.

In one embodiment of the present invention, the content of neutral calcium salicylate in terms of calcium atoms is less than 0.10% by mass (or less than 100 ppm by mass) based on the mass of the composition. By setting the content of neutral calcium salicylate within the aforementioned range, lubricating oil film-forming ability on the sliding surfaces is improved, and thereby, poor lubricity (increased frictional wear) due to the breakdown of the oil film can be prevented.

In one embodiment of the present invention, from the viewpoint of the improvement of the lubricating oil film-forming ability of the lubricating oil composition, the content of neutral calcium salicylate in terms of calcium atoms is preferably 0.08% by mass or less, more preferably 0.04% by mass or less, further preferably 0.01% by mass or less, still further preferably less than 0.01% by mass, and particularly preferably 0% by mass.

The content of neutral calcium salicylate in terms of calcium atoms can also be indicated with "ppm by mass," and in such a case, the content is preferably 800 ppm by mass or less, more preferably 400 ppm by mass or less, further preferably 100 ppm by mass or less, still further preferably less than 100 ppm by mass, and particularly preferably 0 ppm by mass.

From the improvement of the base number of the lubricating oil composition, the content of the calcium-based detergent in terms of calcium atoms is preferably 0.11% by mass or more, more preferably 0.12% by mass or more, and further preferably 0.13% by mass or more, based on the total amount of the composition. On the other hand, from the viewpoint of reducing the ash content in the lubricating oil composition, the content of the calcium-based detergent in terms of calcium atoms is preferably 0.20% by mass or less, more preferably 0.19% by mass or less, and further preferably 0.18% by mass or less. The content of the calcium-based detergent in terms of calcium atoms is preferably 0.11% to 0.20% by mass, more preferably 0.12% to 0.19% by mass, and further preferably 0.13% to 0.18% by mass, based on the total amount of the composition.

Otherwise, the content of the calcium-based detergent in terms of calcium atoms can also be indicated with "ppm by mass," and in such a case, the content is preferably 1100 ppm by mass or more, more preferably 1200 ppm by mass or more, and further preferably 1300 ppm by mass or more, based on the total amount of the composition. On the other hand, the content is preferably 2000 ppm by mass or less, more preferably 1900 ppm by mass or less, and further preferably 1800 ppm by mass or less. In addition, the content of the calcium-based detergent in terms of calcium atoms is preferably 1100 to 2000 ppm by mass, more preferably 1200 to 1900 ppm by mass, and further preferably 1300 to 1800 ppm by mass, based on the total amount of the composition.

(Magnesium-Based Detergent)

From the viewpoint of the improvement of the base number of the lubricating oil composition, the lubricating oil composition may comprise a magnesium-based detergent. Specific examples of such a magnesium-based detergent may include magnesium salicylate, magnesium phenate, and magnesium sulfonate. As a magnesium-based detergent, a basic or overbased magnesium-based detergent is preferably used, and its base number is preferably 10 to 500 mgKOH/g. The base number is more preferably 200 to 500 mgKOH/g, and further preferably 250 to 450 mgKOH/g. The "base number" is measured by applying a potentiometric titration method (base number-perchloric acid method) in accordance with JIS K2501:2003.

From the viewpoint of reducing the ash content in the lubricating oil composition, the content of the magnesium-based detergent in terms of magnesium atoms is preferably 0.05% by mass or less, more preferably 0.04% by mass or less, and further preferably 0.03% by mass or less, based on the total amount of the composition. It is adequate even if the lubricating oil composition does not comprise such a magnesium-based detergent. However, from the viewpoint of the improvement of the base number of the lubricating oil composition, the content of the magnesium-based detergent in terms of magnesium atoms is preferably 0% by mass or more, more preferably 0.05% by mass or more, and further preferably 0.01% by mass or more, based on the total amount of the composition. The content of the magnesium-based detergent in terms of magnesium atoms is preferably 0% to 0.05% by mass, more preferably 0.005 to 0.04% by mass, further preferably 0.01% to 0.03% by mass, based on the total amount of the composition.

Otherwise, the content of the magnesium-based detergent in terms of magnesium atoms can also be indicated with "ppm by mass," and in such a case, the content is preferably 500 ppm by mass or less, more preferably 400 ppm by mass or less, and further preferably 300 ppm by mass or less, based on the total amount of the composition. On the other hand, the content of the magnesium-based detergent in terms of magnesium atoms is preferably 0 ppm by mass or more, more preferably 50 ppm by mass or more, and further preferably 100 ppm by mass or more. In addition, the content of the magnesium-based detergent in terms of magnesium atoms is preferably 0 to 500 ppm by mass, more preferably 50 to 400 ppm by mass, and further preferably 100 to 300 ppm by mass, based on the total amount of the composition.

(Other Metallic Detergents)

The lubricating oil composition may comprise metallic detergents other than the calcium-based detergent and the magnesium-based detergent (i.e., other metallic detergents). Examples of such other metallic detergents may include organic metallic compounds containing metal atoms selected from alkali metal atoms and alkaline-earth metal atoms other than calcium and magnesium. Specific examples thereof may include metal salicylate, metal phenate, and metal sulfonate. From the viewpoint of the improvement of cleanliness at a high temperature, the metal atoms include sodium atoms and barium atoms. Specific examples may include a sodium-based detergent and a barium-based detergent. Other metallic detergents may be used alone or may also be used in combination of two or more types.

As such other metallic detergents, basic or overbased metallic detergents are preferably used, and the base number thereof is preferably 10 to 500 mgKOH/g. In addition, the base number is more preferably 200 to 500 mgKOH/g, and further preferably 250 to 450 mgKOH/g. The "base number" is measured by applying a potentiometric titration method (base number-perchloric acid method) in accordance with JIS K2501:2003.

The amount of metal atoms derived from such other metallic detergents is preferably 0% to 0.20% by mass, more preferably 0% to 0.18% by mass, and further preferably 0% to 0.16% by mass, based on the total amount of the composition. When the amount of metal atoms derived from such other metallic detergents is indicated with "ppm by mass," it is preferably 0 to 2000 ppm by mass, more preferably 0 to 1800 ppm by mass, and further preferably 0 to 1600 ppm by mass, based on the total amount of the composition.

In the present invention, the content ratio of molybdenum atoms derived from the above-described organic molybdenum compound to soap groups derived from the metallic detergent based on the lubricating oil composition, [Mo/soap groups] (hereinafter simply referred to as "the ratio of Mo/soap groups" at times), is 0.02 or more at a mass ratio. In the present description, the "soap groups derived from the metallic detergent" mean detergent components other than carbonate components in the structural components of the metallic detergents. For example, when the metallic detergents are constituted with a calcium-based detergent and a magnesium-based detergent, the carbonate components indicate calcium carbonate and magnesium carbonate, and the soap groups indicate alkyl salicylate groups, alkyl sulfonate groups and alkyl phenate groups, in the detergent components other than the carbonates (i.e., detergent molecules of calcium or magnesium salicylate, calcium or magnesium sulfonate, calcium or magnesium phenate, and the like). The content of the "soap groups derived from the metallic detergent" can be obtained by performing rubber membrane dialysis on the calcium-based detergent, then treating a rubber membrane remaining after the dialysis with hydrochloric acid, and then quantifying a component extracted with diethyl ether as a soap portion.

By setting the ratio of Mo/soap groups to be 0.02 or more, the lubricating oil film-forming ability of the lubricating oil composition can be improved. From the viewpoint of easy improvement of the lubricating oil film-forming ability of the lubricating oil composition, the ratio of Mo/soap groups is more preferably 0.03 or more, further preferably 0.04 or more, and still further preferably 0.06 or more. On the other hand, from the viewpoint of solubility, the ratio of Mo/soap groups is preferably 0.20 or less, more preferably 0.16 or less, and further preferably 0.14 or less. The ratio of Mo/soap groups is, for example, preferably 0.02 to 0.20, more preferably 0.04 to 0.16, and further preferably 0.06 to 0.14.

The total content of the metallic detergents in terms of metal atoms in the lubricating oil composition can be set, such that sulfated ash derived from the metallic detergents can preferably be in the range of 0.4% to 1.0% by mass, more preferably in the range of 0.4% to 0.9% by mass, and further preferably in the range of 0.5% to 0.8% by mass, based on the total amount of the composition.

Besides, the total sulfated ash comprised in the lubricating oil composition (i.e., the total sulfated ash also including sulfated ash derived from other components) is not particularly limited, as long as the sulfated ash derived from the metallic detergents is within the above-described range. The total sulfated ash comprised in the lubricating oil composition is preferably 0.5% to 1.2% by mass, more preferably 0.6% to 1.0% by mass, and further preferably 0.7% to 0.9% by mass, based on the total amount of the lubricating oil composition.

The "sulfated ash" can be measured according to the method described in JIS K2272:1998.

[Component (D): Other Components]

The lubricating oil composition comprises, as necessary, lubricating oil additives such as a pour point depressant, an antioxidant, an ashless dispersant, a defoaming agent, a corrosion inhibitor, a metal deactivator, and an antistatic agent, within a range in which the effects of the present invention are not inhibited. These lubricating oil additives may be each used alone, or may also be used in combination of two or more types.

(Pour Point Depressant)

Examples of the pour point depressant used herein may include an ethylene-vinyl acetate copolymer, a condensate of chlorinated paraffin and naphthalene, a condensate of chlorinated paraffin and phenol, poly(meth)acrylate, and polyalkylstyrene, and among these, polymethacrylate is particularly preferably used. These pour point depressants may be used alone or may also be used in combination of two or more types. The content of the pour point depressant is not particularly limited, and it is preferably 0.01% to 5.0% by mass based on the total amount of the composition.

Besides, when poly(meth)acrylate is used as such a pour point depressant, the weight average molecular weight thereof is generally less than 100,000 (for example, in the range of 30,000 to 90,000), and the pour point depressant is distinguished from the after-mentioned viscosity index improver.

(Antioxidant)

As an antioxidant used herein, any given antioxidant can be appropriately selected and used from known antioxidants that have been conventionally used as antioxidants for lubricating oil. Examples of the antioxidant may include an amine-based antioxidant, a phenolic antioxidant, a molybdenum-based antioxidant, a sulfur-based antioxidant, and a phosphorus-based antioxidant.

These antioxidants may be used alone as a single type, or may be used in combination with two or more types. In general, the antioxidants are preferably used in combination of two or more types. The content of the antioxidant(s) is not particularly limited, and it is preferably 0.01% to 10% by mass based on the total amount of the composition.

(Ashless Dispersant)

Examples of the ashless dispersant used herein may include polybutenyl succinimide having a number average molecular weight (Mn) of 900 to 3,500 and having a polybutenyl group (polybutenyl succinic acid monoimide, polybutenyl succinic acid bisimide, etc.), polybutenyl benzylamine, polybutenyl amine, and derivatives thereof, such as a boric acid-modified product (a borylation product of polybutenyl succinimide, etc.). These ashless dispersants may be used alone or may also be used in combination of two or more types. The content of the ashless dispersant(s) is not particularly limited, and it is preferably 0.10% to 15% by mass based on the total amount of the composition.

(Defoaming Agent)

Examples of the defoaming agent used herein may include dimethyl polysiloxane and polyacrylate. These defoaming agents may be used alone or may also be used in combination of two or more types. The content of the defoaming agent(s) is not particularly limited, and it is preferably 0.0002% to 0.15% by mass based on the total amount of the composition.

(Corrosion Inhibitor)

Examples of the corrosion inhibitor that can be used herein may include: alkyl or alkenyl succinate derivatives, such as a half ester of dodecenylsuccinic acid, an octadecenylsuccinic anhydride, and dodecenylsuccinamide; polyhydric alcohol partial esters, such as sorbitan monooleate, glycerin monooleate, and pentaerythritol monooleate; amines, such as rosin amine and N-oleyl sarcosine; and a dialkyl phosphite amine salt. These corrosion inhibitors may be used alone or may also be used in combination of two or more types. The content of the corrosion inhibitor(s) is not particularly limited, and it is preferably 0.01% to 5.0% by mass based on the total amount of the composition.

(Metal Deactivator)

Examples of the metal deactivator used herein may include benzotriazole, a triazole derivative, a benzotriazole derivative, and a thiadiazole derivative. These metal deactivators may be used alone or may also be used in combination of two or more types. The content of the metal deactivator(s) is not particularly limited, and it is preferably 0.01% to 3.0% by mass based on the total amount of the composition.

From the viewpoint of achieving the low viscosity of lubricating oil to accomplish fuel efficiency, the content of a resin derived from the viscosity index improver in the lubricating oil composition of the present invention is preferably 2% by mass or less, more preferably 1.5% by mass or less, and further preferably 1% by mass or less, based on the total amount of the composition. In one embodiment, the lubricating oil composition does not contain such a viscosity index improver.

Examples of the viscosity index improver may include: PMA viscosity index improvers, such as non-dispersive polyalkyl (meth)acrylate and dispersive polyalkyl (meth) acrylate; OCP viscosity index improvers, such as an olefinic copolymer (e.g., ethylene-propylene copolymer, etc.) and a dispersive olefinic copolymer; and styrene-based copolymers (e.g., a styrene-diene copolymer, a styrene-isoprene copolymer, etc.). Besides, in the present description, the term "alkyl (meth)acrylate" is used to mean both alkyl methacrylate and alkyl acrylate. The alkyl (meth)acrylate constituting polyalkyl (meth)acrylate is, for example, alkyl (meth)acrylate having a linear alkyl group containing 1 to 18 carbon atoms or a branched alkyl group containing 3 to 34 carbon atoms. In the case of polyalkyl (meth)acrylate used as a viscosity index improver, its weight average molecular weight (Mw) is 100,000 to 1,000,000, and more preferably 300,000 to 500,000. It is to be noted that the weight average molecular weight (Mw) can be measured according to gel permeation chromatography (relative to standard polystyrene).

It is to be noted that, in the present description, polyalkyl (meth)acrylate having a weight average molecular weight (Mw) of less than 100,000 is not included in the "viscosity index improver."

<Properties of Lubricating Oil Composition, Etc.>

From the viewpoint of cleanliness, the base number (perchloric acid method) of the lubricating oil composition is preferably 6.0 mgKOH/g or more, more preferably 7.0 mgKOH/g or more, further preferably 7.1 mgKOH/g or more, and particularly preferably 7.2 mgKOH/g or more. On the other hand, from the viewpoint of reducing the ash content in the lubricating oil composition, the base number of the lubricating oil composition is preferably 11.0 mgKOH/g or less, more preferably 10.5 mgKOH/g or less, and further preferably 10.0 mgKOH/g or less. The base number of the lubricating oil composition is preferably 6.0 to 11.0 mgKOH/g, more preferably 7.0 to 11.0 mgKOH/g, further preferably 7.1 to 10.5 mgKOH/g, and particularly preferably 7.2 to 10.0 mgKOH/g. The base number (perchloric acid method) is measured by applying a potentiometric titration method (base number-perchloric acid method) in accordance with JIS K2501:2003.

From the viewpoint of fuel efficiency, the kinematic viscosity of the lubricating oil composition at 100° C. is preferably 3 to 12 $mm^2/s$, more preferably 3 to 10 $mm^2/s$, further preferably 3 to 9 $mm^2/s$, and particularly preferably 3 to 8 $mm^2/s$.

The viscosity index of the lubricating oil composition is not particularly limited, and from the viewpoint of suppression of a change in viscosity due to temperature change and the improvement of fuel efficiency, the viscosity index of the lubricating oil composition is preferably 80 to 200, more preferably 90 to 180, further preferably 100 to 180, and particularly preferably 110 to 160.

From the viewpoint of fuel efficiency, the HTHS viscosity of the lubricating oil composition at 150° C. (high temperature high shear viscosity) is 1.3 mPa·s or more and less than 2.3 mPa·s, preferably 1.3 mPa·s or more and 2.1 mPa·s or less, and more preferably 1.3 mPa·s or more and 1.8 mPa·s or less. The "HTHS viscosity" is measured according to the method described in the after-mentioned Examples.

The lubricating oil composition of one embodiment has a viscosity index of 80 to 200 (more preferably 90 to 180, further preferably 100 to 180, and particularly preferably 110 to 160). The kinematic viscosity at 100° C. of the lubricating oil composition of one embodiment is 3 to 12 $mm^2/s$ (more preferably 3 to 10 $mm^2/s$, further preferably 3 to 9 $mm^2/s$, and particularly preferably 3 to 8 $mm^2/s$), and the HTHS viscosity at 150° C. of the lubricating oil composition of one embodiment is 1.3 mPa·s or more and less than 2.3 mPa·s (preferably 1.3 mPa·s or more and 2.1 mPa·s or less, and more preferably 1.3 mPa·s or more and 1.8 mPa·s or less). The lubricating oil composition of the present embodiment is particularly preferable as an engine oil with a viscosity grade of 0W-3 to 0W-12 (in particular, a viscosity grade of 0W-4 to 0W-12).

[Method for Producing Lubricating Oil Composition]

The method for producing a lubricating oil composition is not particularly limited. Component (A), component (B), component (C), and as necessary, component (D) may be mixed with one another according to any method, and the production method is not limited. In one embodiment, the method for producing a lubricating oil composition has a step of mixing the organic molybdenum compound (B), the metallic detergent (C), and as necessary, other components (D), into the base oil (A).

[Intended Use of Lubricating Oil Composition]

The lubricating oil composition of the present embodiment is excellent in terms of fuel efficiency and lubricating performance (low frictional wear). As such, the lubricating oil composition of the present embodiment can be preferably used as a lubricating oil (engine oil) for a gasoline engine, diesel engine or gas engine for use in vehicles such as motorcycles and four-wheeled vehicles, generators, ships, etc. or for an internal combustion engine for use in outboard motors. The present lubricating oil composition can be filled into the internal combustion engine, and can be used as a lubricating oil that lubricates among individual components of the internal combustion engine.

Moreover, taking into consideration the properties of the lubricating oil composition, one embodiment of the present invention provides an internal combustion engine, in which the above-described lubricating oil composition is used. Furthermore, one embodiment of the present invention provides a method of reducing abrasion of an internal combustion engine, comprising driving the internal combustion engine using the above-described lubricating oil composition.

EXAMPLES

Hereinafter, the present invention will be described in detail with reference to the following examples. However, the technical scope of the present invention is not limited to these examples.

The physical properties of individual raw materials used in Examples and Comparative Examples and the lubricating oil compositions of Examples and Comparative Examples were measured in accordance with the following procedures.

(1) Kinematic Viscosity

The kinematic viscosity at 40° C. (KV (40° C.)) and the kinematic viscosity at 100° C. (KV (100° C.)) were measured using a glass capillary viscometer in accordance with JIS K2283:2000.

(2) Viscosity Index

The viscosity index (VI) was measured in accordance with JIS K2283:2000.

(3) HTHS Viscosity (High Temperature High Shear Viscosity)

In accordance with ASTM D 4741, a lubricating oil composition was sheared at 150° C. at a shear velocity of $10^6$/s and thereafter, the viscosity (HTHS 150) was measured.

(4) Contents of Calcium Atoms (Ca), Magnesium Atoms (Mg), and Molybdenum Atoms (Mo)

Each content was measured in accordance with JPI-5S-38-2003.

(5) Content of Detergent-Derived Soap Groups

A rubber membrane dialysis was performed on a calcium-based detergent, and the rubber membrane remaining after completion of the dialysis was then treated with hydrochloric acid, followed by extraction with diethyl ether. The thus extracted component was quantified as a soap portion, so that the content (% by mass) of the "soap groups derived from the metallic detergent" in the lubricating oil composition was calculated.

(6) Ratio of Mo/Soap Groups

The content (% by mass) of the molybdenum atoms (Mo) was divided by the content (% by mass) of the detergent-derived soap groups to calculate the "ratio of Mo/soap groups" (mass ratio).

(7) Base Number

The base number is a value measured by a potentiometric titration method (base number-perchloric acid method) in accordance with JIS K2501:2003.

(8) Weight Average Molecular Weight (Mw)

The weight average molecular weight (Mw) was measured using a gel permeation chromatograph device (manufactured by Agilent Technologies International Japan, Ltd., "1260-type HPLC") under the following conditions, and the obtained value was converted to a value in terms of standard polystyrene.

(Measurement Conditions)

Column: two columns of "Shodex LF404," which are successively connected with each other Column temperature: 35° C.

Developing solvent: Chloroform

Flow rate: 0.3 mL/min (9) Sulfated Ash

The sulfated ash was measured in accordance with JIS K2272:1998.

Examples 1 to 9 and Comparative Examples 1 and 2

Individual components shown in Table 1 below were mixed into a base oil, so as to prepare the lubricating oil compositions of individual Examples and Comparative Examples, each containing the base oil and such individual components.

The components used in Table 1 are as follows.

(1) Base Oil (Component (A))

a1: Mineral oil (hydrorefined mineral oil; kinematic viscosity at 100° C.: 4 $mm^2$/s, viscosity index: 125)

a2: Mineral oil (hydrorefined mineral oil; kinematic viscosity at 100° C.: 3 $mm^2$/s, viscosity index: 110)

a3: Mineral oil (hydrorefined mineral oil; kinematic viscosity at 100° C.: 8 $mm^2$/s, viscosity index: 140)

(2) Organic Molybdenum Compound (Component (B))

b1: MoDTC (molybdenum dialkyl dithiocarbamate, content of molybdenum atoms: 10.0% by mass, content of nitrogen atoms: 1.6% by mass, content of sulfur atoms: 11.5% by mass, product name: "SAKURA-LUBE 515" (manufactured by ADEKA Corporation))

b2: Molybdenum-amine complex (content of molybdenum atoms: 8.0% by mass, content of nitrogen atoms: 2.4% by mass, product name: "HiTEC4716" (manufactured by Afton Chemical Corporation)

(3) Calcium-Based Detergent (Component (C))

c1: Overbased calcium salicylate (content of calcium atoms: 7.9% by mass, content of soap groups: 50% by mass)

c2: Overbased calcium sulfonate (content of calcium atoms: 11.7% by mass, content of soap groups: 23% by mass)

c3: Neutral calcium sulfonate (content of calcium atoms: 2.2% by mass, content of soap groups: 52% by mass)

c4: Neutral calcium salicylate (content of calcium atoms: 2.3% by mass, content of soap groups: 30% by mass)

(4) Magnesium-Based Detergent (Component (C))

c5: Overbased magnesium sulfonate (content of magnesium atoms: 9.5% by mass, content of soap groups: 30% by mass)

(5) Other Components (Components (D))

d1: Borylation product of polybutenyl succinimide d2: Polybutenyl succinimide d3: ZnDTP (zinc dialkyl dithiophosphate)

d4: Antioxidant d5: Pour point depressant (polymethacrylate (PMA); weight average molecular weight (Mw): 60,000)

The lubricating oil compositions prepared in Examples and Comparative Examples were used as test oils, and the following evaluation was carried out. The results are shown in Table 1.

<Lubricating Performance>

The insulation properties of each lubricating oil composition were measured by an ECR method according to the following procedures, and the lubricating oil film-forming ability was then evaluated.

The insulation properties were measured by an ECR method using a high frequency reciprocating rig (HFRR) friction testing machine. Specifically, 15 mV of voltage was applied to 10 ohms of a balance resistance arranged in series between test pieces (a disk and a ball) retained in a bath filled with 2 mL of the lubricating oil composition, so as to create a voltage-dividing circuit with the contact site of the test pieces and the balance resistance. The ball was rubbed against the disk, and 5 minutes after initiation of the friction, the voltage (Vt) at the contact site between the test pieces (the disk and the ball) and the voltage (Vb) applied to the balance resistance were measured. Then, the ratio (Vt/(Vb+Vt)) between the voltage (Vb+Vt) added to the entire circuit and the voltage applied to the balance resistance was calculate, so that the insulation properties of the contact site were evaluated. If the voltage (Vt) at the contact site of the test pieces was 0, it means that a metal contact was generated between the test pieces (i.e., the oil film was broken). On the other hand, if the voltage (Vt) at the contact site of the test pieces was 15 mV, it means that the test pieces were separated from each other due to the lubrication oil, and that the contact was not generated (i.e., the oil film was still formed).

Test device: HFRR friction testing machine (manufactured by PCS instruments)

Test pieces: a disk with a diameter of 10 mm (AISI E-52100 steel) and a ball with a diameter of 6 mm (AISI E-52100 steel)

Load: 400 g
Temperature: 100° C.
Test time: 5 minutes
Frequency: 50 Hz
Amplitude: 1 mm Based on the measurement results of the insulation properties by the ECR method, lubricating performance was evaluated according to the following criteria. As the ratio (voltage ratio) of the voltage (Vb) applied to the balance resistance to the voltage (Vb+Vt) added to the entire circuit, (Vt/(Vb+Vt)), increases, it is said that the lubricating oil composition is excellent in terms of lubricating oil film-forming ability (low frictional wear).

A: A voltage ratio of 0.85 or more
B: A voltage ratio of 0.75 or more and less than 0.85
C: A voltage ratio of less than 0.74

The results are shown in Table 1.

TABLE 1

| | | | Ex. 1 | Ex. 2 | Ex. 3 | Ex. 4 | Ex. 5 | Ex. 6 | Ex. 7 | Ex. 8 | Ex. 9 | Comp. Ex. 1 | Comp. Ex. 2 | Comp. Ex. 3 | Comp. Ex. 4 |
|---|---|---|---|---|---|---|---|---|---|---|---|---|---|---|---|
| Composition (mass %) | Base oil | a 1 | 28.15 | 98.15 | 68.15 | 97.65 | 97.32 | 96.90 | 97.55 | 96.30 | 94.60 | 97.55 | 97.80 | 95.05 | 97.90 |
| | | a 2 | 70.00 | | | | | | | | | | | | |
| | | a 3 | | | 30.00 | | | | | | | | | | |
| | Organic molybdenum compound | b 1 | 0.35 | 0.35 | 0.35 | 0.35 | 0.35 | 1.00 | 0.35 | 1.00 | 1.00 | 0.35 | 0.10 | 0.35 | 0.10 |
| | | b 2 | | | | | 0.23 | | | | | | | | |
| | Calcium-based detergent | c 1 | | | | 1.70 | | | | | | | | 0.80 | 1.70 |
| | | c 2 | 1.20 | 1.20 | 1.20 | | 1.00 | 1.00 | 1.00 | 0.80 | 0.60 | 1.00 | 1.00 | | |
| | | c 3 | | | | | 0.80 | 0.80 | 0.80 | 1.60 | 3.50 | | 0.80 | 3.50 | |
| | | c 4 | | | | | | | | | | 0.80 | | | |
| | Magnesium-based detergent | c 5 | 0.30 | 0.30 | 0.30 | 0.30 | 0.30 | 0.30 | 0.30 | 0.30 | 0.30 | 0.30 | 0.30 | 0.30 | 0.30 |
| | Borylation product of polybutenyl succinimide | d 1 | 2.00 | 2.00 | 2.00 | 2.00 | 2.00 | 2.00 | 2.00 | 2.00 | 2.00 | 2.00 | 2.00 | 2.00 | 2.00 |
| | Polybutenyl succinimide | d 2 | 2.50 | 2.50 | 2.50 | 2.50 | 2.50 | 2.50 | 2.50 | 2.50 | 2.50 | 2.50 | 2.50 | 2.50 | 2.50 |
| | ZnDTP | d 3 | 1.10 | 1.10 | 1.10 | 1.10 | 1.10 | 1.10 | 1.10 | 1.10 | 1.10 | 1.10 | 1.10 | 1.10 | 1.10 |
| | Antioxidant | d 4 | 1.80 | 1.80 | 1.80 | 1.80 | 1.80 | 1.80 | 1.80 | 1.80 | 1.80 | 1.80 | 1.80 | 1.80 | 1.80 |
| | Pour point depressant | d 5 | 0.10 | 0.10 | 0.10 | 0.10 | 0.10 | 0.10 | 0.10 | 0.10 | 0.10 | 0.10 | 0.10 | 0.10 | 0.10 |
| | Total | | 100 | 100 | 100 | 100 | 100 | 100 | 100 | 100 | 100 | 100 | 100 | 100 | 100 |
| Properties | Basic number (mgKOH/g) | | 7.3 | 7.3 | 7.3 | 7.3 | 7.1 | 6.9 | 6.9 | 6.5 | 6.1 | 7.2 | 6.9 | 6.1 | 7.3 |
| | Kinematic viscosity at 40° C. ($mm^2/s$) | | 14.4 | 23.2 | 30.7 | 23.4 | 23.6 | 23.8 | 23.5 | 24.2 | 25.3 | 23.4 | 23.6 | 25.3 | 23.4 |
| | Kinematic viscosity at 100° C. ($mm^2/s$) | | 3.6 | 4.9 | 5.9 | 5.0 | 5.0 | 5.0 | 5.0 | 5.1 | 5.3 | 4.9 | 5.0 | 5.3 | 5.0 |
| | Viscosity index | | 133 | 141 | 145 | 143 | 142 | 141 | 142 | 143 | 145 | 142 | 142 | 145 | 143 |
| | HTMS viscosity at 150° C. (mPa · s) | | 1.4 | 1.8 | 2.1 | 1.8 | 1.8 | 1.8 | 1.8 | 1.8 | 1.9 | 1.8 | 1.8 | 1.8 | 1.8 |
| | Ca (mass %) | | 0.14 | 0.14 | 0.14 | 0.14 | 0.14 | 0.14 | 0.14 | 0.14 | 0.14 | 0.14 | 0.14 | 0.14 | 0.14 |
| | Mg (mass %) | | 0.03 | 0.03 | 0.03 | 0.03 | 0.03 | 0.03 | 0.03 | 0.03 | 0.03 | 0.03 | 0.03 | 0.03 | 0.03 |
| | Mo (mass %) | | 0.03 | 0.03 | 0.03 | 0.03 | 0.05 | 0.09 | 0.03 | 0.09 | 0.09 | 0.03 | 0.01 | 0.03 | 0.01 |
| | Content of calcium sulfonate in terms of calcium atoms (mass %) | | 0.14 | 0.14 | 0.14 | 0 | 0.14 | 0.14 | 0.14 | 0.14 | 0.14 | 0.11 | 0.14 | 0.04 | 0.14 |
| | Detergent-derived soap bases (mass %) | | 0.37 | 0.37 | 0.37 | 0.94 | 0.74 | 0.74 | 0.74 | 1.11 | 2.05 | 0.56 | 0.74 | 2.31 | 0.94 |
| | Ratio of Mo/soap bases | | 0.08 | 0.08 | 0.08 | 0.03 | 0.07 | 0.12 | 0.04 | 0.08 | 0.04 | 0.05 | 0.01 | 0.01 | 0.01 |
| | Detergent-derived sulfated ash (mass %) | | 0.56 | 0.56 | 0.56 | 0.56 | 0.56 | 0.56 | 0.56 | 0.56 | 0.56 | 0.56 | 0.56 | 0.56 | 0.56 |
| | Sulfated ash (mass %) | | 0.78 | 0.78 | 0.78 | 0.78 | 0.79 | 0.81 | 0.78 | 0.81 | 0.81 | 0.78 | 0.77 | 0.78 | 0.78 |
| Evaluation | Voltage ratio measured by ECR method | | 0.98 | 0.78 | 0.82 | 0.81 | 0.96 | 0.99 | 0.80 | 0.95 | 0.92 | 0.60 | 0.70 | 0.67 | 0.70 |
| | Lubricating performance | | A | B | B | B | A | A | B | A | A | C | C | C | C |

As shown in Table 1, it was confirmed that the lubricating oil compositions (Examples 1 to 3 and 5 to 9) comprising 0.12% by mass or more of calcium sulfonate (c2 and/or c3), wherein the ratio of Mo/soap groups was 0.02 or more at a mass ratio, had an HTHS viscosity at 150° C. of 1.3 mPa·s or more and less than 2.3 mPa·s, and thus that these lubricating oil compositions had low viscosity and excellent lubricating performance.

In addition, as shown in Table 1, it was confirmed that the lubricating oil composition (Example 4) comprising overbased calcium salicylate (c1), wherein the ratio of Mo/soap groups was 0.02 or more at a mass ratio, had an HTHS viscosity at 150° C. of 1.3 mPa·s or more and less than 2.3 mPa·s, and thus that the lubricating oil composition had low viscosity and excellent lubricating performance.

In contrast, the lubricating oil composition (Comparative Example 1) containing 0.11% by mass of calcium sulfonate, and the lubricating oil compositions (Comparative Example 2, Comparative Example 3, and Comparative Example 4) having the ratio of Mo/soap groups that was less than 0.02 were poor in terms of lubricating performance.

The scope of the present invention is not restrained by the above explanation. Thus, those other than the above-described examples may be appropriately modified and carried out within a range in which the spirit of the present invention is not impaired. It is to be noted that all documents and publications cited in the present description are incorporated herein by reference in their entireties, regardless of the purpose thereof. In addition, the present description includes the contents as disclosed in the claims and description of Japanese Patent Application No. 2019-065480 (filed on Mar. 29, 2020), which is a priority document of the present application.

INDUSTRIAL APPLICABILITY

The lubricating oil composition of the present embodiments has low viscosity and excellent lubricating performance, and it is preferably used, for example, as an internal combustion engine oil used in an internal combustion engine.

The invention claimed is:

1. A lubricating oil composition, comprising:

a base oil;

an organic molybdenum compound; and a metallic detergent comprising a calcium-based detergent and a magnesium-based detergent, wherein the calcium-based detergent comprises calcium sulfonate in an amount of 0.12% by mass or more in terms of calcium atoms based on the mass of the lubricating oil composition, wherein the content of a magnesium-based detergent is less than 0.05% by mass in terms of magnesium atoms, based on total lubricating oil composition mass, wherein the lubricating oil composition has a base number in a range of from more than 6.1 to 11.0 mg KOH/g, wherein a [Mo/soap groups] mass content ratio of molybdenum atoms derived from the organic molybdenum compound to soap groups derived from the metallic detergent based on the lubricating oil composition is 0.06 or more, and wherein the lubricating oil composition has an HTHS viscosity at 150° C. in a range of from 1.3 to less than 2.3 mPa·s.

2. The composition of claim 1, comprising the organic molybdenum compound in an amount of 0.02% by mass or more and less than 0.10% by mass, based in terms of molybdenum atoms on the total lubricating oil composition mass.

3. The composition of claim 1, comprising the magnesium-based detergent in an amount of less than 0.04% by mass in terms of magnesium atoms, based on the total lubricating oil composition mass.

4. The composition of claim 1, wherein the organic molybdenum compound comprises at least one selected from the group consisting of molybdenum dithiocarbamate, molybdenum dithiophosphate, a molybdenum-amine complex, and a molybdenum-imide complex.

5. The composition of claim 1, further comprising:

a viscosity index improver in an amount of 2% by mass or less, based on the total lubricating oil composition mass.

6. The composition of claim 1, comprising neutral calcium salicylate in an amount of less than 0.01% by mass in terms of calcium atoms, based on the total lubricating oil composition mass.

7. The composition of claim 1, having a kinematic viscosity at 100° C. in a range of from 2.0 to 7.1 $mm^2/s$.

8. The composition of claim 1, wherein (ii) the calcium-based detergent only comprises overbased calcium sulfonate; or (iv) the calcium-based detergent only comprises overbased calcium sulfonate and neutral calcium sulfonate.

9. The composition of claim 1, wherein a [Mo/soap groups] mass content ratio is in a range of from 0.06 to less than 2.05.

10. An internal combustion engine, comprising the lubricating oil composition of claim 1.

11. A method of reducing abrasion of an internal combustion engine, the method comprising:

driving the internal combustion engine with the lubricating oil composition of claim 1.

12. The composition of claim 1, comprising, based on the total lubricating oil composition mass:

the base oil in a range of from 85 to 99.5 wt. %, the base oil comprising a mineral oil, molybdenum dithiocarbamate, molybdenum dithiophosphate, and/or molybdenum-amine complex;

overbased calcium salicylate in a range of from 0.6 to 1.7 wt. %; and further additive(s) in up to 7.5 wt. %.

13. The composition of claim 12, comprising the magnesium-based detergent in a range of from 0.01 to 0.03% by mass in terms of magnesium atoms, based on the total lubricating oil composition mass.

14. The composition of claim 1, wherein the calcium-based detergent only comprises overbased calcium sulfonate.

15. The composition of claim 1, wherein the calcium-based detergent only comprises overbased calcium salicylate and neutral calcium salicylate.

16. The composition of claim 1, wherein the calcium-based detergent only comprises overbased calcium sulfonate and neutral calcium sulfonate.

17. The composition of claim 1, comprising the magnesium-based detergent in a range of from 0.01 to 0.03% by mass in terms of magnesium atoms, based on the total lubricating oil composition mass.

18. The composition of claim 1, wherein a [Mo/soap groups] mass content ratio is in a range of from 0.06 to 1.11.

19. The composition of claim 1, consisting of, based on the total lubricating oil composition mass:

the base oil in a range of from 85 to 99.5 wt. %, the base oil comprising a mineral oil, overbased calcium salicylate in a range of from 0.6 to 1.7 wt. %;

a magnesium based detergent in a range of from greater than 0 to 0.3 wt. %;

molybdenum dithiocarbamate, molybdenum dithiophosphate, and/or molybdenum-amine complex in a range of from greater than 0 to 1 wt. %;

borylated polybutenyl succinimide in a range of from greater than 0 to 2 wt. %;

polybutenyl succinimide in a range of from greater than 0 to 2.5 wt. %;

zinc dithiophosphate in a range of from greater than 0 to 1.1 wt. %; and further additive(s) in up to 1.9 wt. %.

20. A lubricating oil composition, comprising:

a base oil;

an organic molybdenum compound; and a metallic detergent comprising a calcium-based detergent and a magnesium-based detergent, wherein the calcium-based detergent comprises calcium sulfonate in an amount of 0.12% by mass or more in terms of calcium atoms based on the mass of the lubricating oil composition, wherein the content of a magnesium-based detergent is less than 0.05% by mass in terms of magnesium atoms, based on total lubricating oil composition mass, wherein a [Mo/soap groups] mass content ratio of molybdenum atoms derived from the organic molybdenum compound to soap groups derived from the metallic detergent based on the lubricating oil composition is in a range of from 0.06 to less than 2.05, and wherein the lubricating oil composition has an HTHS viscosity at 150° C. in a range of from 1.3 to less than 2.3 mPa·s.

* * * * *